US005749722A

United States Patent [19]

Driscoll et al.

[11] Patent Number: 5,749,722

[45] Date of Patent: May 12, 1998

[54] SINGLE CHARGE CONTINUOUS ROTARY RETORT FURNACE WITH AN ACCESSIBLE DOOR

[75] Inventors: Michael E. Driscoll, Marlboro; Michael A. Dorio, Whitehouse Station; Frank T. Keogh, Lebanon, all of N.J.

[73] Assignee: American Gas Furnace Company, Rancocas, N.J.

[21] Appl. No.: 654,254

[22] Filed: May 28, 1996

[51] Int. Cl.[6] ..... F27B 7/14

[52] U.S. Cl. ..... 432/118; 432/103; 414/149; 414/150

[58] Field of Search ..... 432/103, 105, 432/110, 114, 118; 414/149, 150, 152, 158, 196

[56] References Cited

U.S. PATENT DOCUMENTS

| | | | |
|---|---|---|---|
| 3,829,283 | 8/1974 | Wulf | 432/103 |
| 3,878,947 | 4/1975 | Bayly | 432/117 |
| 4,090,622 | 5/1978 | Smith et al. | 432/103 |
| 4,259,060 | 3/1981 | Korzeb et al. | 432/118 |
| 4,273,493 | 6/1981 | Bayly et al. | 414/149 |

*Primary Examiner*—Henry A. Bennett
*Assistant Examiner*—Gregory Wilson
*Attorney, Agent, or Firm*—Ezra Sutton

[57] ABSTRACT

A single charge continuous rotary retort furnace for heat treating machine parts in a sealed atmosphere, including a rotary retort furnace housing having an inlet and outlet end with a feeder assembly at the inlet end that has a plurality of chambers for supplying the machine parts to the rotary retort furnace housing to be heat treated. In addition, the rotary retort furnace includes a locking collar assembly for connecting the feeder assembly to the inlet end of the rotary retort furnace housing having locking tabs for locking the feeder assembly to the locking collar assembly; pistons and cylinders for rotating the locking collar assembly relative to the feeder assembly; and a device for sealing the feeder assembly relative to the locking collar assembly to create an atmospheric seal in the retort furnace housing for enabling the machine parts to be heat treated. The rotary retort furnace further includes drive means for rotating as a unit the retort furnace housing, the feeder assembly and the locking collar assembly for heat treating the machine parts. The rotary retort furnace also includes an internal discharge chute assembly cooperating with the outlet end of the rotary retort furnace housing for removing therefrom the heat-treated machine parts, and an outer discharge chute assembly cooperating with the internal discharge chute assembly for receiving the heat-treated machine parts from the internal discharge chute assembly and for transferring the machine parts to a quench medium in a quench tank.

17 Claims, 11 Drawing Sheets

SINGLE CHARGE CONTINUOUS ROTARY RETORT FURNACE WITH AN ACCESSIBLE DOOR

FIELD OF THE INVENTION

This invention relates generally to a new and improved single charge continuous rotary retort furnace for annealing, brazing, heat treating or sintering of metal components. More particularly, this invention relates to a new and improved feeder system, discharge system, retort furnace access, and retort furnace configuration.

BACKGROUND OF THE INVENTION

Several types of multi-functional rotary furnaces are currently being used for heat treating of metal components. The control of furnace atmosphere is paramount to a successful heat treating process, such that a properly applied and controlled furnace atmosphere provides a protective environment to guard against adverse effects of air (oxygen) to metal parts, i.e. ball bearings, when they are exposed to oxygen at elevated temperatures. Proper heat treatment occurs by using non-oxidated gases at defined temperatures, volumetric flows, pressures and diffusion rates to insure the proper annealing, brazing, carburizing or sintering of a particular metal part.

Present rotary furnaces for heat treating of metal parts still use manual labor for loading the volumetric feeder with parts. Also, the feeder system is manually bolted to one end of the furnace which increases downtime and decreases productivity. Further, there is no immediate access to the inside of the retort furnace. The retort furnace still uses spacing discs of expensive alloys that wear out quickly. In the quenching process of current retort furnaces the metal parts are exposed to air which lowers the quality of the quench and damages the quality of the metal products.

There remains a need for a new and improved single charge retort furnace having such innovative features as a micro feeder system, a feeder locking collar, an improved internal retort configuration and an external discharge chute having an internal protective atmospheric seal.

DESCRIPTION OF THE PRIOR ART

Multi-functional rotary furnaces of various designs, appearances and constructions have been disclosed in the prior art. For example, U.S. Pat. Nos. 3,878,947 and 4,273,403 disclose volumetric feeders attached to a retort furnace by a plurality of bolts, making it difficult and time consuming to remove the volumetric feeder from the furnace to provide access.

U.S. Pat. Nos. 1,606,124; 3,943,637; 4,087,334; and 5,083,382 disclose a rotary kiln, a rotary drum and other types of rotary apparatus for drying, heat treating and the like. However, none of these prior art patents disclose the design and construction of the present invention.

Accordingly, it is an object of the present invention to provide a single charge continuous rotary furnace having a micro feeder system which automatically fills the hopper feeder with metal parts to be treated; and feeds those metal parts into the retort furnace. This volumetric or spiral feeder system reduces manual labor and time, increases safety of the operator and increases productivity of the operation.

Another object of the present invention is to provide a single charge continuous rotary furnace having a micro feeder system with an automatic feeder locking collar which provides for immediate access to the inside of the retort assembly. This reduces downtime and costly repairs, and increases productivity.

Another object of the present invention is to provide a single charge continuous rotary furnace having a new and improved retort design with a larger diameter opening at the feeder end for ease of access to the retort.

Another object of the present invention is to provide a single charge continuous rotary furnace having a closed assembly with an improved pattern design with rows of tumbling ribs made of high tensile strength metal which allows for the proper tempering of the heat treated metal parts within the rotary retort. This eliminates the use of spacing discs, reduces the replacement of internal parts, reduces downtime maintenance and labor costs, and increases productivity.

Another object of the present invention is to provide a single charge continuous rotary furnace having a new and improved external discharge chute with an internal protective atmospheric seal which improves the quality of the quench and the quality of the metal products produced.

Another object of the present invention is to provide a single charge continuous rotary furnace having a controlled gaseous atmosphere for the proper heat treating of metal parts before quenching, thereby eliminating the need for many other downstream procedures which reduces the cost of producing a heat treated metal product and provides a substantial cost savings.

Another object of the present invention is to provide a single charge continuous rotary furnace which can be automatically operated by the use of an electronically controlled computerized console such that the machine parts being heat treated can be loaded to a given number automatically and discharged automatically without manual intervention.

Another object of the present invention is to provide a single charge continuous rotary furnace having sight-glass viewing ports to view the machine parts being heat treated in the retort chamber.

A further object of the present invention is to provide a single charge continuous rotary furnace which can be produced in an economical manner and is readily affordable by a manufacturer.

SUMMARY OF THE INVENTION

In accordance with the present invention, there is provided an improved single charge continuous rotary retort furnace for heat treating machine parts in a sealed atmosphere, including a rotary retort furnace housing having an inlet and outlet end with a feeder assembly at the inlet end that has a plurality of chambers for supplying the machine parts to the rotary retort furnace housing to be heat treated. In addition, the rotary retort furnace includes a locking collar assembly for connecting the feeder assembly to the inlet end of the rotary retort furnace housing having locking tabs for locking the feeder assembly to the locking collar assembly; pistons and cylinders for rotating the locking collar assembly relative to the feeder assembly; and a device for sealing the feeder assembly relative to the locking collar assembly to create an atmospheric seal in the retort furnace housing for enabling the machine parts to be heat treated. The rotary retort furnace further includes drive means for rotating as a unit the retort furnace housing, the feeder assembly and the locking collar assembly for heat treating the machine parts. The rotary retort furnace also includes an internal discharge chute assembly cooperating with the outlet end of the rotary retort furnace housing for removing therefrom the heat-treated machine parts, and an outer discharge chute assembly cooperating with the internal discharge chute assembly for receiving the heat-treated machine parts from the internal discharge chute assembly and for transferring the machine parts to a quench medium in a quench tank.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED EMBODIMENT OVERVIEW

Figure 1:
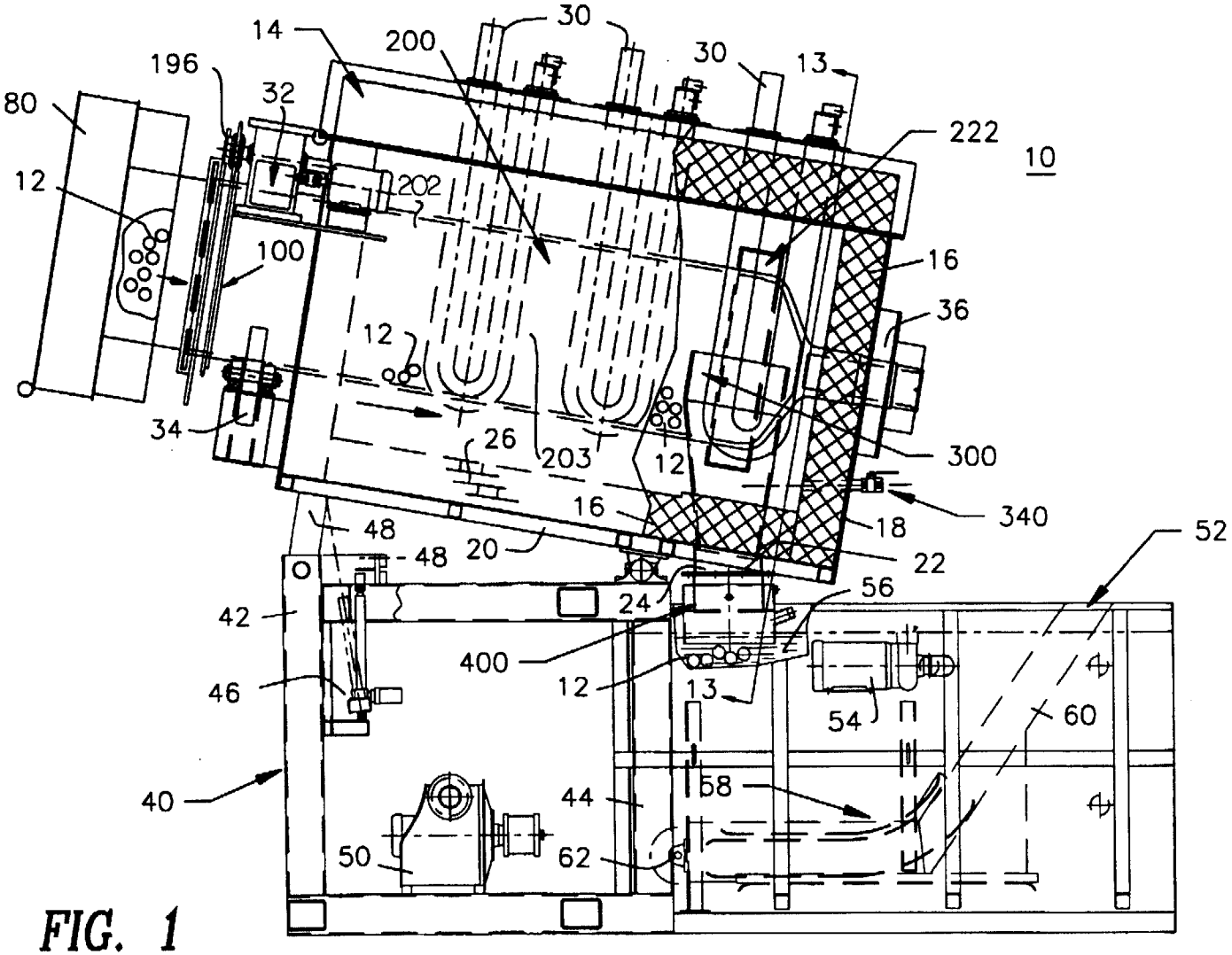
FIG. 1 is a side elevational view of the single charge continuous rotary retort furnace of the preferred embodiment of the present invention showing its major component assemblies in an operational mode.
Figure 2:
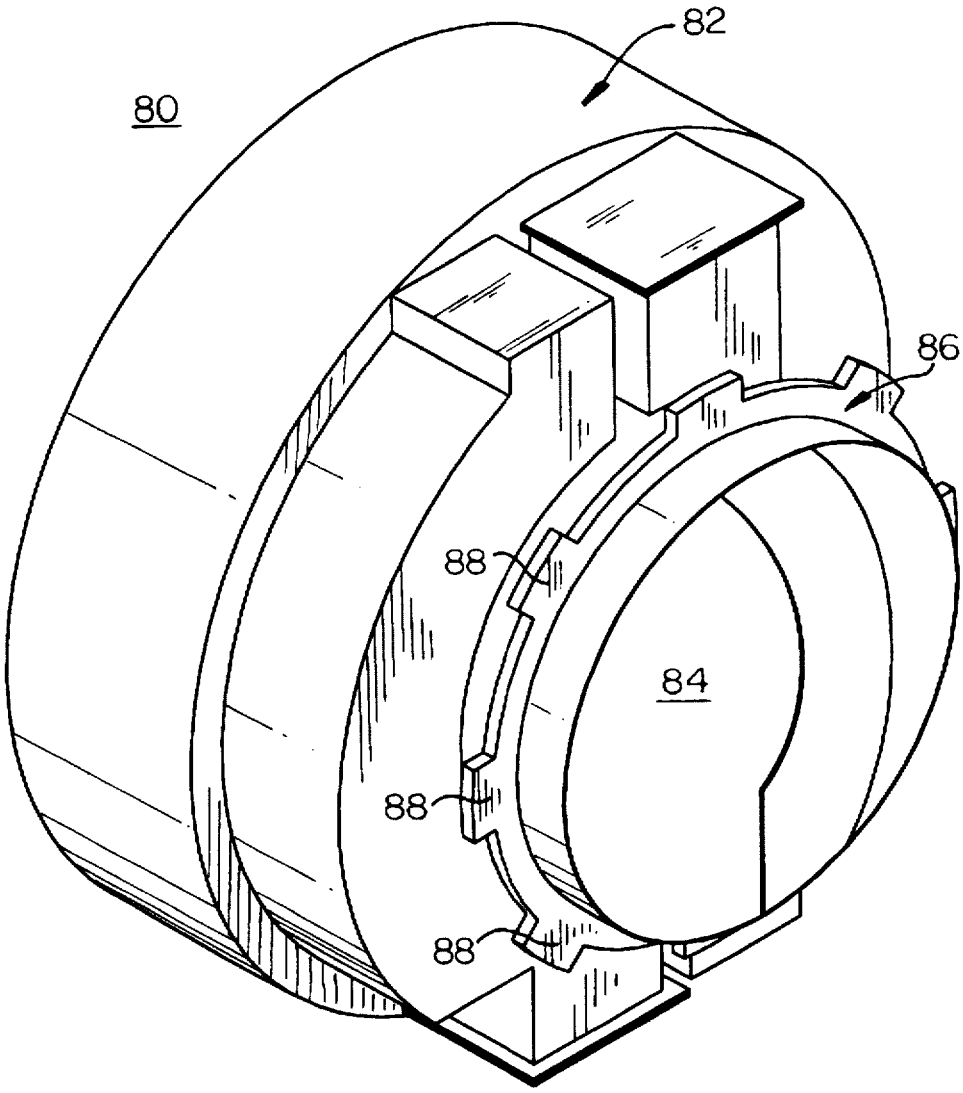
FIG. 2 is a rear perspective view of the spiral feeder assembly of the present invention showing its major component parts therein.
Figure 5:
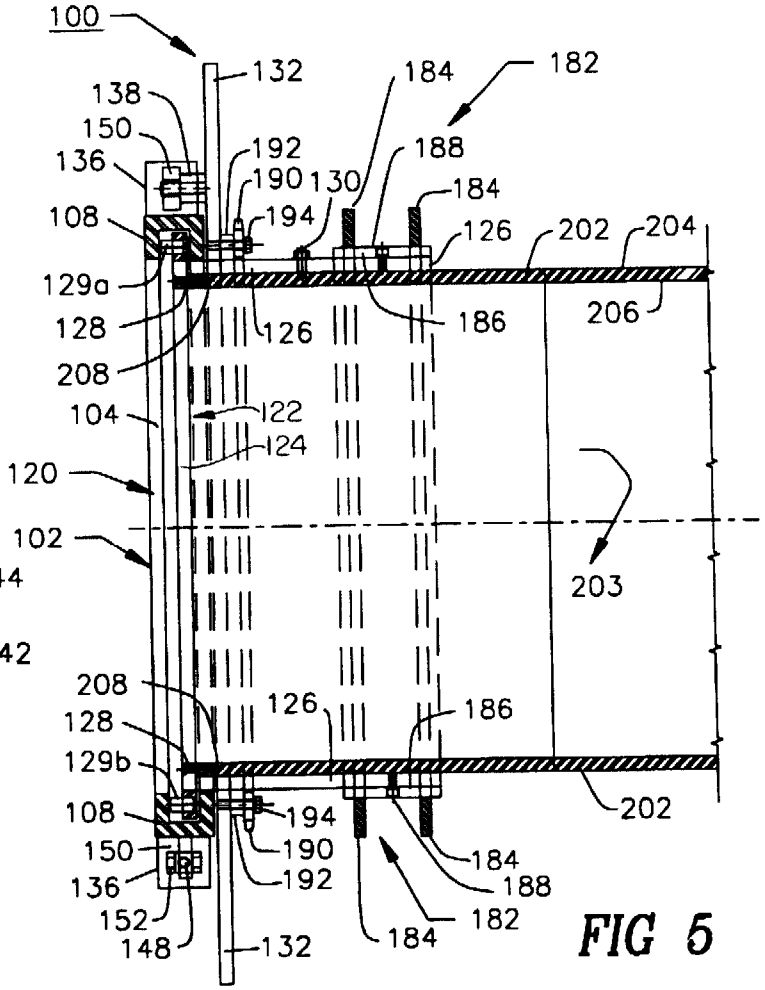
FIG. 5 is a side cross-sectional view of the locking collar assembly of the present invention taken along lines 4—4 of FIG. 3 showing the retaining hub, locking collar assembly back plate and retort support wheel tire assembly attached to the retort furnace.
Figure 7:
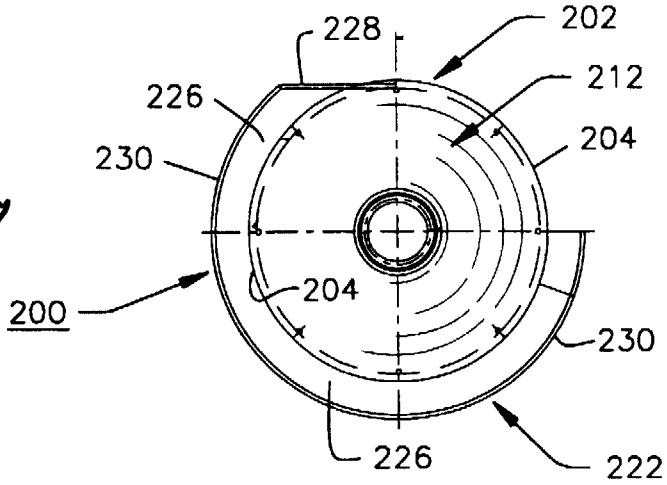
FIG. 7 is a front plan view of the rotary retort furnace of the present invention showing the external pathway chute for discharging of the heat treated machine parts.
Figure 6:
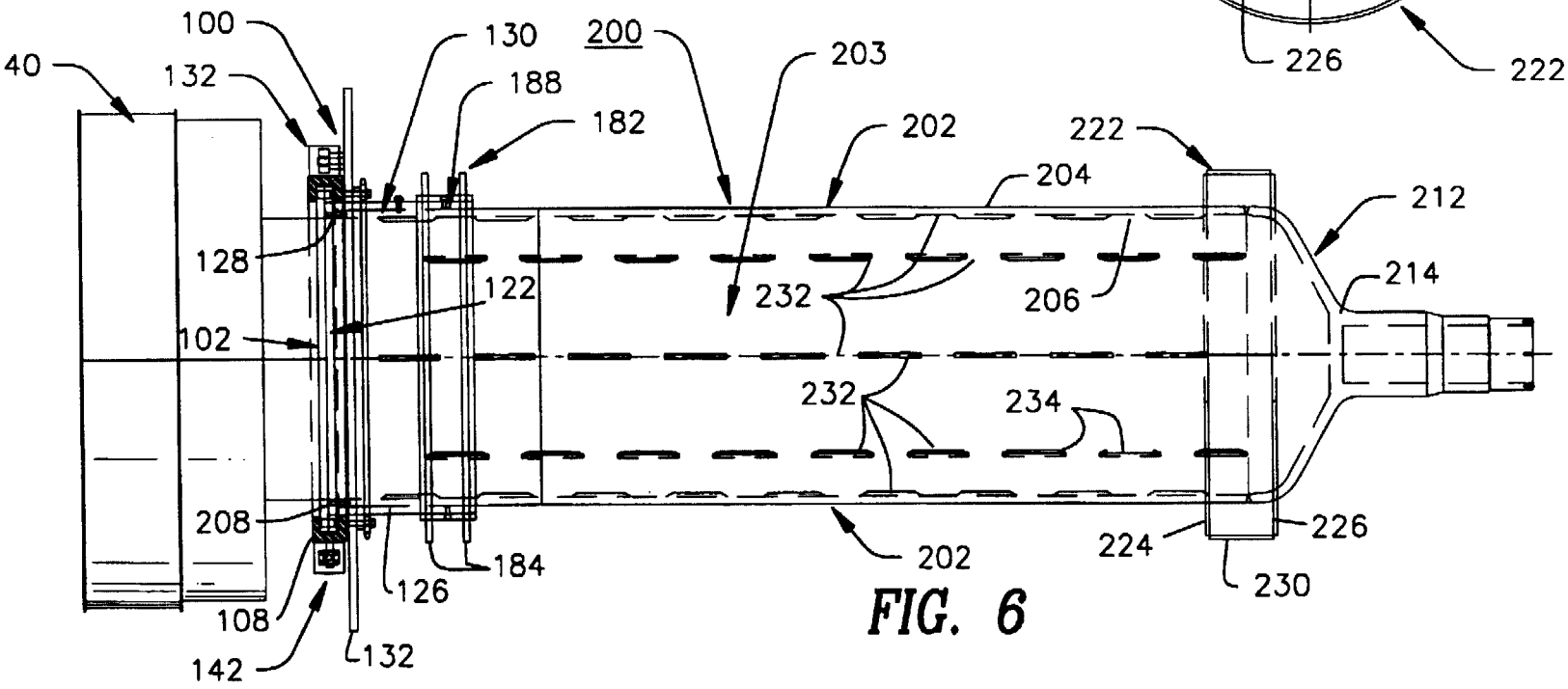
FIG. 6 is a side elevational view of the single charge continuous rotary retort furnace of the present invention showing the spiral feeder assembly, the locking collar assembly and the rotary retort furnace assembly.
Figure 8:
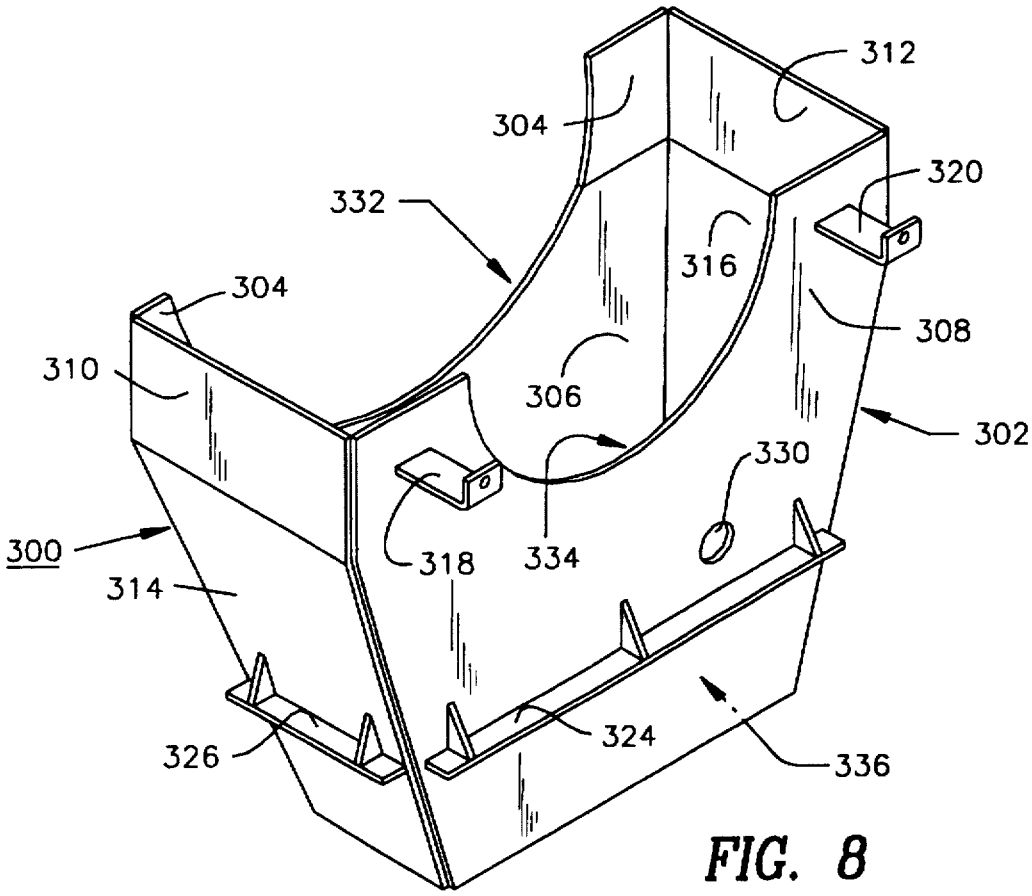
FIG. 8 is a perspective view of the internal discharge chute assembly of the present invention showing all of its major component parts contained thereon in an assembled form.
Figure 9:
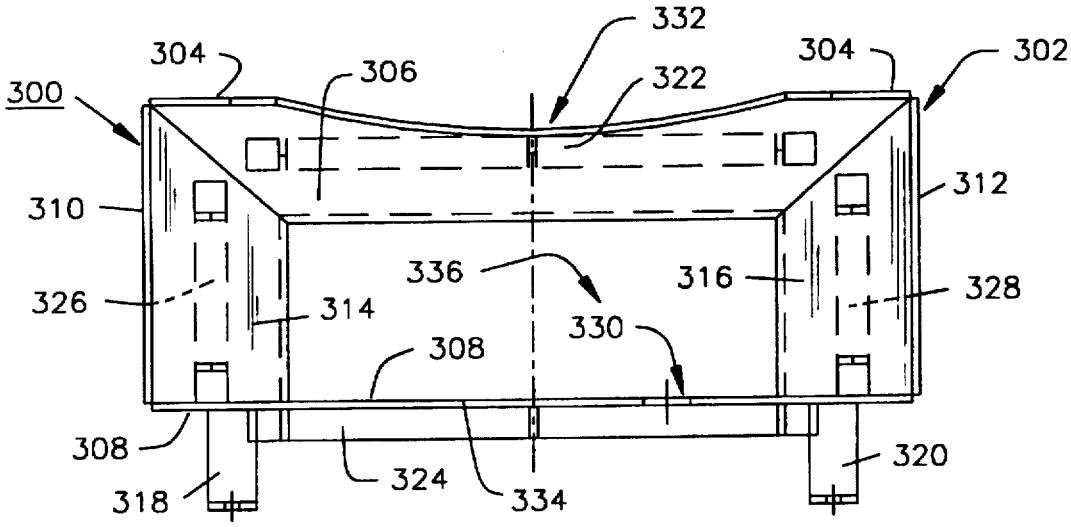
FIG. 9 is a top plan view of the internal discharge chute assembly of the present invention showing its internal surface contour for discharging of the heat treated machine parts.
Figure 10:
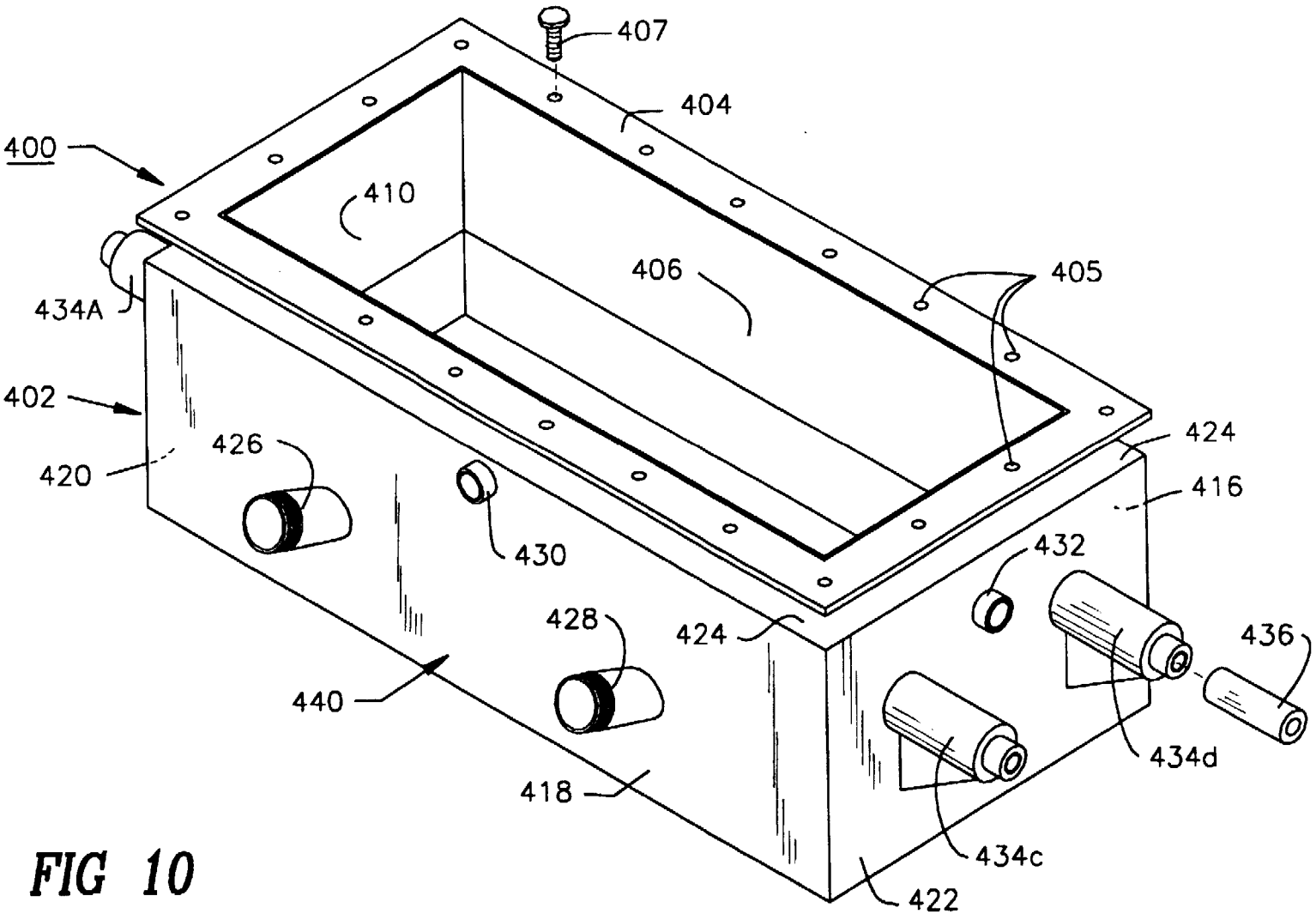
FIG. 10 is a perspective view of the outer discharge chute assembly of the present invention showing all of its major component parts contained therein.
Figure 11:
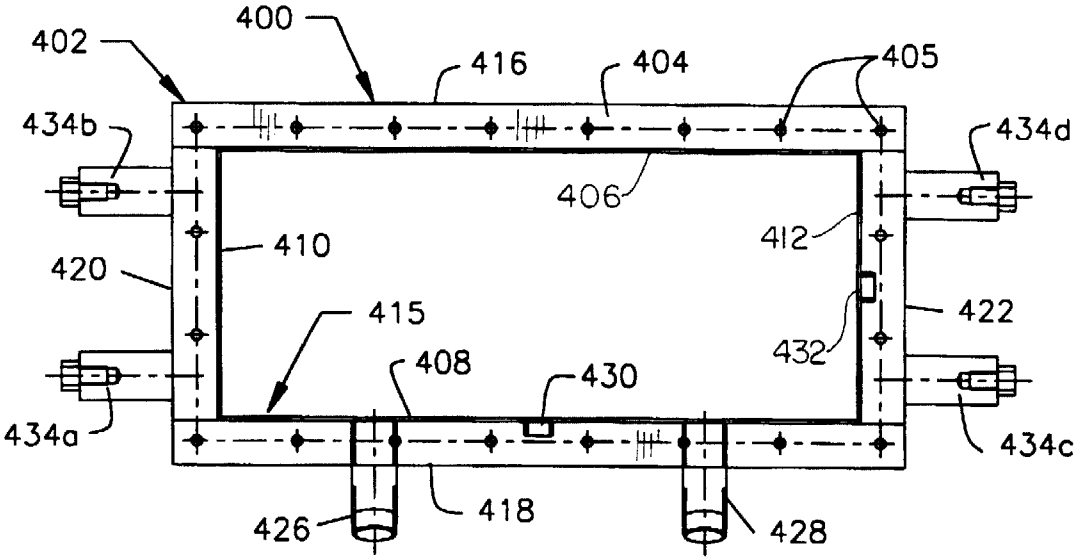
FIG. 11 is a top plan view of the outer discharge chute assembly of the present invention showing the piping egress for the quenching oil which cools the heat treated machine parts.
Figure 12:
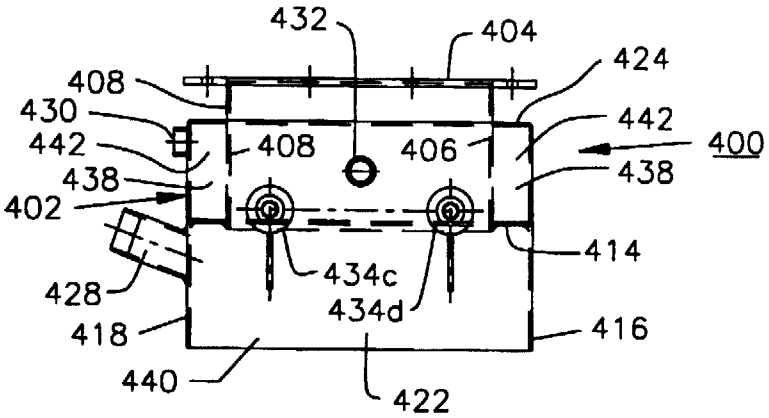
FIG. 12 is a side elevational view of the outer discharge chute assembly of the present invention showing a 20° angle for the inlet and outlet coupling for the quenching oil.
Figure 13:
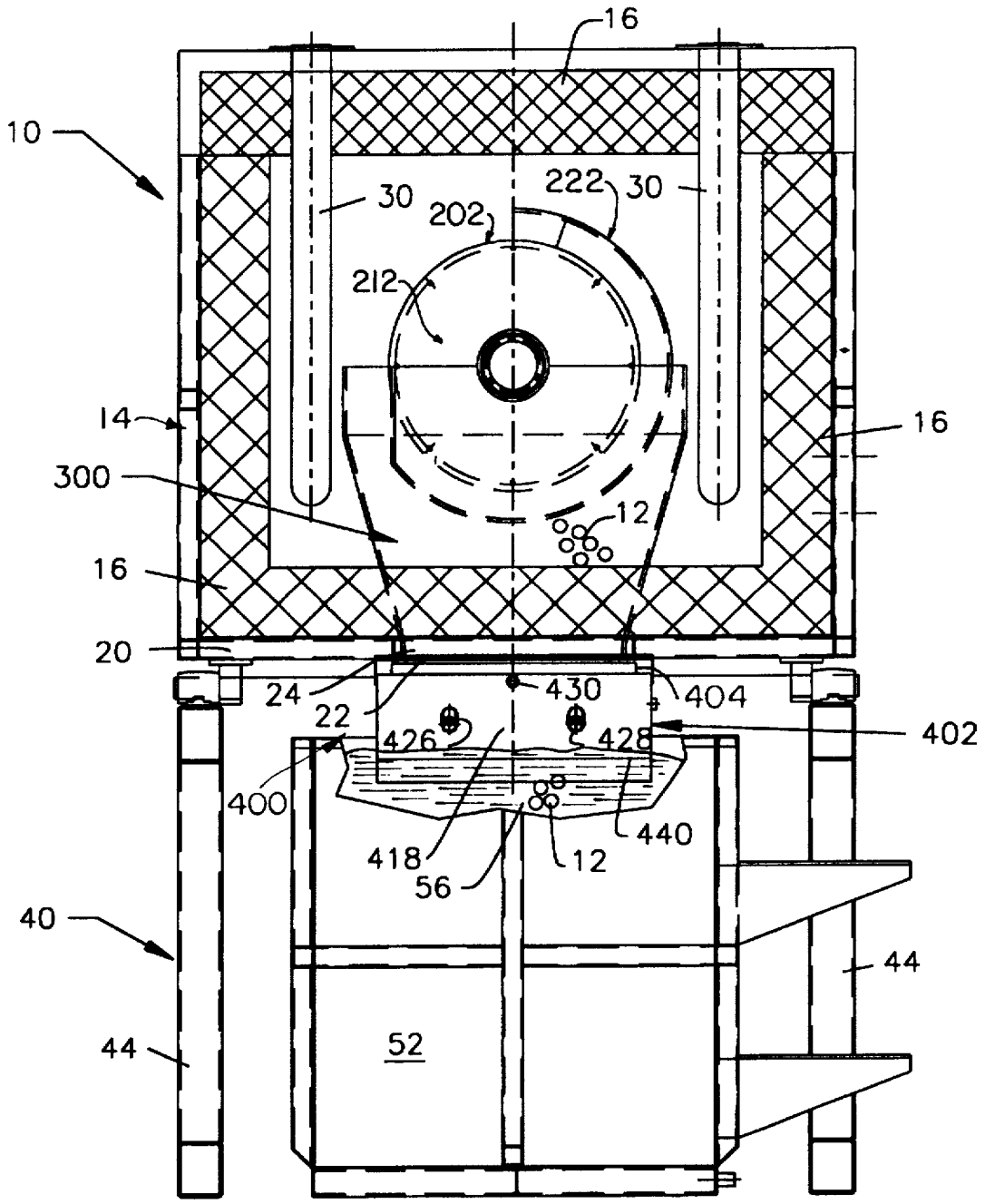
FIG. 13 is a rear cross-sectional view of the rotary retort furnace of the present invention showing the interrelationship of the retort furnace to the internal discharge chute and to the external discharge chute to the quench tank.

The preferred embodiment of the present invention provides for a new and improved single charge continuous rotary retort furnace 10, used for annealing, brazing, heat treating or sintering of metal components 12, as represented by FIGS. 1 through 13. FIGS. 1 and 5 show the single charge continuous rotary retort furnace 10 an d its various major component assemblies contained therein. FIG. 2 shows the spiral feeder assembly 80 and its various components parts contained therein. FIGS. 3A, 3B, 4, and 5 show the locking collar assembly 100 and its various component parts contained therein. FIGS. 1, 6, and 7 show the rotary retort furnace assembly 200 and its various component parts contained therein. FIGS. 8 and 9 show the internal discharge chute assembly 300 and its various component parts contained therein. FIGS. 10 to 12 show the outer/external discharge chute assembly 400 and its various component parts contained therein. FIG. 13 shows the internal and external discharge chutes in an operational mode.

The single charge continuous rotary retort furnace 10, as shown in FIG. 1, includes a spiral feeder assembly 80; a locking collar assembly 100; a rotary retort furnace assembly 200; an internal discharge chute assembly 300; and an external discharge chute assembly 400. As depicted in FIG. 1, the continuous rotary retort furnace 10 fits inside an insulated furnace casing 14 having an interior insulation 16, a furnace casing rear wall 18 and a furnace casing bottom wall 20. In addition, furnace casing 14 further includes a furnace gasket 22 and furnace mounting flange 24 for use with the external discharge chute assembly 400; a brick lining floor 26; a plurality of radiant tubing 28 for heating of the retort assembly 200; a drive system 32 which turns the retort assembly 200 in a clockwise or counter clockwise direction; support wheels 34 for supporting the charge end of retort housing 202 while allowing rotary retort assembly 200 to rotate; and a bearing assembly 36 for enabling the retort assembly 200 to rotate while providing an atmospheric seal to the furnace chamber 203.

Figure 14:
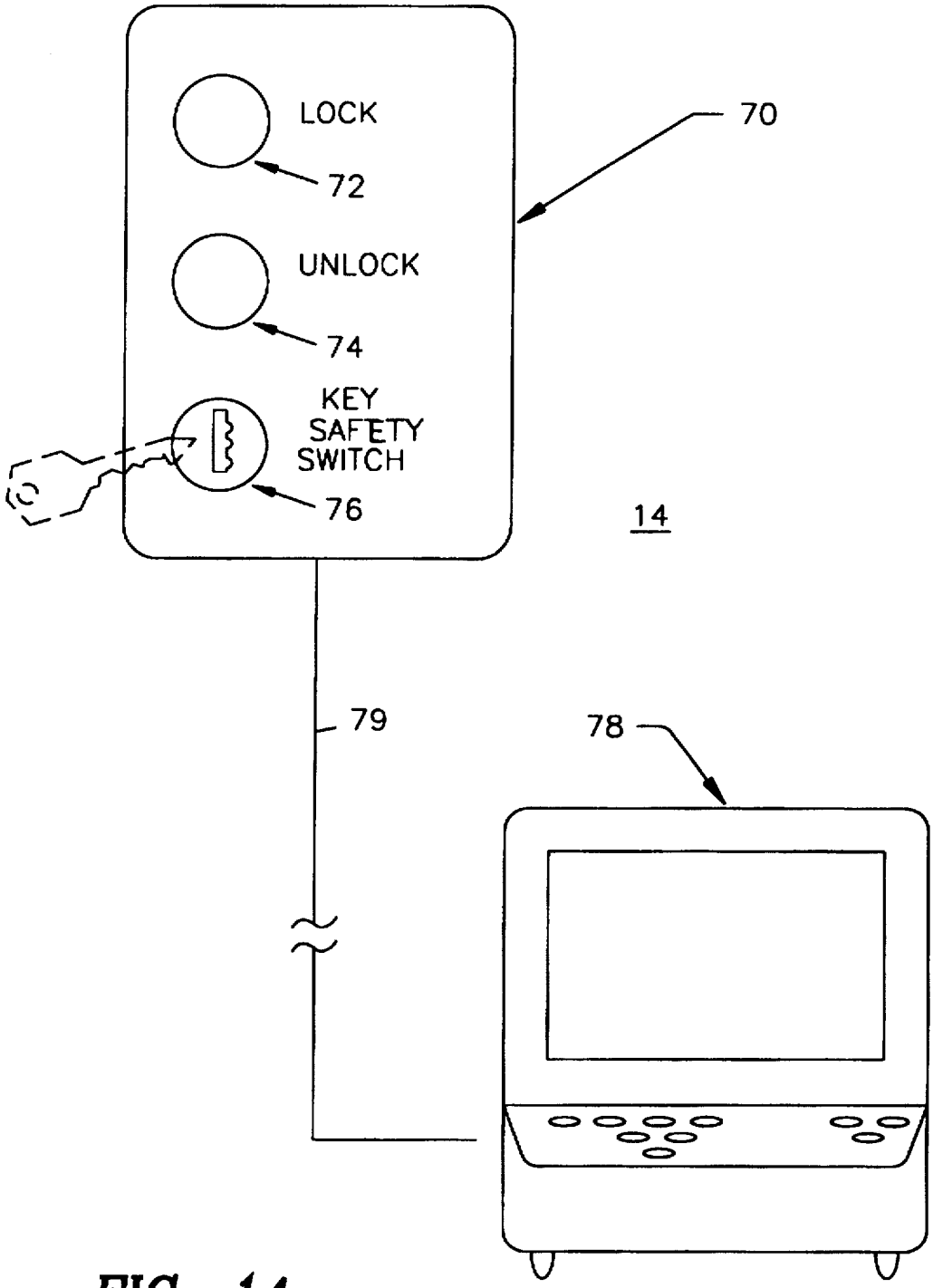
FIG. 14 is a schematic diagram of the electronically controlled computerized console of the present invention showing its unlock, lock and safety switch buttons.

There is an electronically controlled computerized console 70 having a "LOCK" push button 72, an "UNLOCK" push button 74 and a key interlock safety switch 76 for activation of the "LOCK" and "UNLOCK" push buttons 72 and 74, as shown in FIG. 14, being electrically attached to computer 78 via line 79. In addition, the continuous rotary retort furnace 10 sits upon a steel frame structure 40 having front and rear support legs 42 and 44 for furnace accessibility. Frame structure 40 also supports the main section of retort housing 202 and allows for the furnace casing 114 to pivot. There is a ¼ hp motor drive 46 for pivoting furnace casing 14 via a support frame device 48. Support frame 40 also supports a combustion blower 50 for supplying air to the gas burners (not shown). The support frame 40 also has a detachably connected quench tank 52 having a circulation pump 54 for a quench medium 56. There is a conveyor system 58 that includes a conveyor frame 60 with a conveyor belt 62 located within the interior of quench tank 52, as shown in FIG. 1.

VOLUMETRIC/SPIRAL FEEDER ASSEMBLY 80

The single charge continuous rotary retort furnace 10, as depicted in FIGS. 1, 2, and 5, includes a volumetric or spiral feeder assembly 80 having a volumetric or spiral feeder housing 82 which allows for a controlled and specified volumetric feed rate of component machine parts 12 to be fed via feeder chamber 84 to the rotary retort furnace assembly 200 for heat treatment. In addition, the feeder assembly 80 includes an integrally attached flange 86 having male mounting tabs 88. This flange 86 having mating tabs 88 allows the locking collar assembly 100 to grab and lock the feeder assembly 80 to the rotary retort furnace assembly 200. This mechanical procedure creates an atmospheric seal for the continuous rotary retort furnace 10 which enables the machine parts 12 to be heat treated under a protective (no oxygen) atmosphere for proper carburizing and the like.

LOCKING COLLAR ASSEMBLY 100

The locking collar assembly 100, as shown in FIGS. 1 through 5, includes the following major component sub-assemblies: a locking ring sub-assembly 102, a retaining hub sub-assembly 122, a locking collar sub-assembly back plate 132; a pair of locking ring pneumatic cylinders 142*a* and 142*b*; a safety interlock pneumatic assembly 162; a retort support tire assembly 182, a retort driven sprocket 190 and a sprocket spacer ring 192.

As previously mentioned, the locking collar assembly 100 is used to hold and lock the volumetric spiral feeder assembly 80 to the rotary retort furnace assembly 200 which then provides an atmospheric seal within the retort furnace housing 202.

The locking ring sub-assembly 102 components include a face plate 104, a center ring 106, a back plate 108, a plurality of locking ring connection arms 110*a* to 110*d*, a plurality of safety locking arms 112*a* to 112*d* having safety locking arm pins 114 and a plurality of locking ring cam rollers 116*a* to 116*d*. The locking ring 102 of locking collar assembly 100 is mounted to the outer surface wall 204 of retort furnace housing 202, and when rotated, the locking ring 102 locks and compresses the feeder mounting flange 86 to the locking ring retaining flange 124 to insure an air-tight fit in making the aforementioned atmospheric seal. The locking collar assembly 100 and its component parts are essentially made of steel or alloys of stainless steel.

The face plate 104 having female mounting tabs 118 is open in the center with the center opening 120 being approximately 34 inches in diameter. Face plate 104 is welded to the center ring 106 which forms the lip 107 that grabs and compresses the feeder mounting flange 86 to the locking ring retaining flange 124. The center ring 106 provides the clearance necessary to fit both the feeder mounting flange 86 and the locking ring retaining flange 124 inside the locking ring 102. The locking ring back plate 108 is welded to the center ring 106 and to the face plate 104 which forms the primary structure of the locking ring sub-assembly 102.

The back plate 108 supports the locking ring sub-assembly 102 onto the retaining hub sub-assembly 122 which allows the locking ring sub-assembly 102 to rotate on the retort adapting hub of retaining hub sub-assembly 122. The plurality of locking ring connection arms 110*a* to 110*d* provides for the connection of the locking ring rotation pneumatic cylinders 142*a* and 142*b* from the locking ring sub-assembly 102 to the locking collar assembly back plate 132. The plurality of locking ring safety locking arms 112*a* to 112*d* along with the safety locking arm pins 114*a* to 114*d* allow for the safety interlock pneumatic assembly 162 to hold the locking ring sub-assembly 102 in the full clockwise position when the locking ring rotation pneumatic cylinders 142*a* and 142*b* are activated to close.

The plurality of locking ring cam rolls 116*a* to 116*d* are rollers which cause the locking ring sub-assembly 102 to compress the feeder mounting flange 86 to the locking ring retaining flange 124 when the locking ring rotation pneumatic cylinders 142*a* and 142*b* are activated to close. The reverse action of cam rolls 116*a* to 116*d* also cause the locking ring sub-assembly 102 to loosen when the locking ring rotation pneumatic cylinders 142*a* and 142*b* are activated to an open position which moves the locking ring sub-assembly assembly 102 in a counter clockwise direction.

The retaining hub sub-assembly 122 components include a locking ring retaining flange 124; a retort adapting hub 126 having alignment pins 129; and machine screws 128 and set screws 130 used for anchoring the retaining hub 122 to the rotary retort furnace housing 202. The locking ring retaining flange 124 includes a plurality of mounting hole openings 125 for attaching the retaining hub assembly 122 to the rotary retort furnace housing 202 via flat head anchoring machine screws 128 (½ inch by 2 inches).

The locking ring retaining flange 124 is a steel ring which holds the locking ring sub-assembly 102 onto the retaining hub sub-assembly 122. This flange 124 contains a plurality of mounting openings 125 in which the retaining hub assembly 122 is anchored to the retort 202 via machine screws 128.

The retort adapting hub 126 is a machined steel tire which fits over the retort housing 202. This hub 126 is used for the main support mechanism for the locking ring assembly 102, and the retort support wheel tire assembly 182. Further, this hub 126 also makes the locking collar assembly 100 turn concentric with the rotary retort furnace assembly 200.

Alignment pins 129*a* and 129*b*, made of one inch (1") diameter steel, are installed into the locking ring retaining flange 124, such that these pins 129*a* and 129*b* allow the feeder mounting flange 86 to be lined up properly when the feeder assembly 80 is installed into the locking collar assembly 100. In addition, the alignment pins 129*a* and 129*b* also provide a positive driving force from the locking collar assembly 100 to the feeder assembly 80, such that the feeder assembly 80 does not rely only on the compression force of the locking collar assembly 100 to turn the feeder assembly 80.

Figure 4:
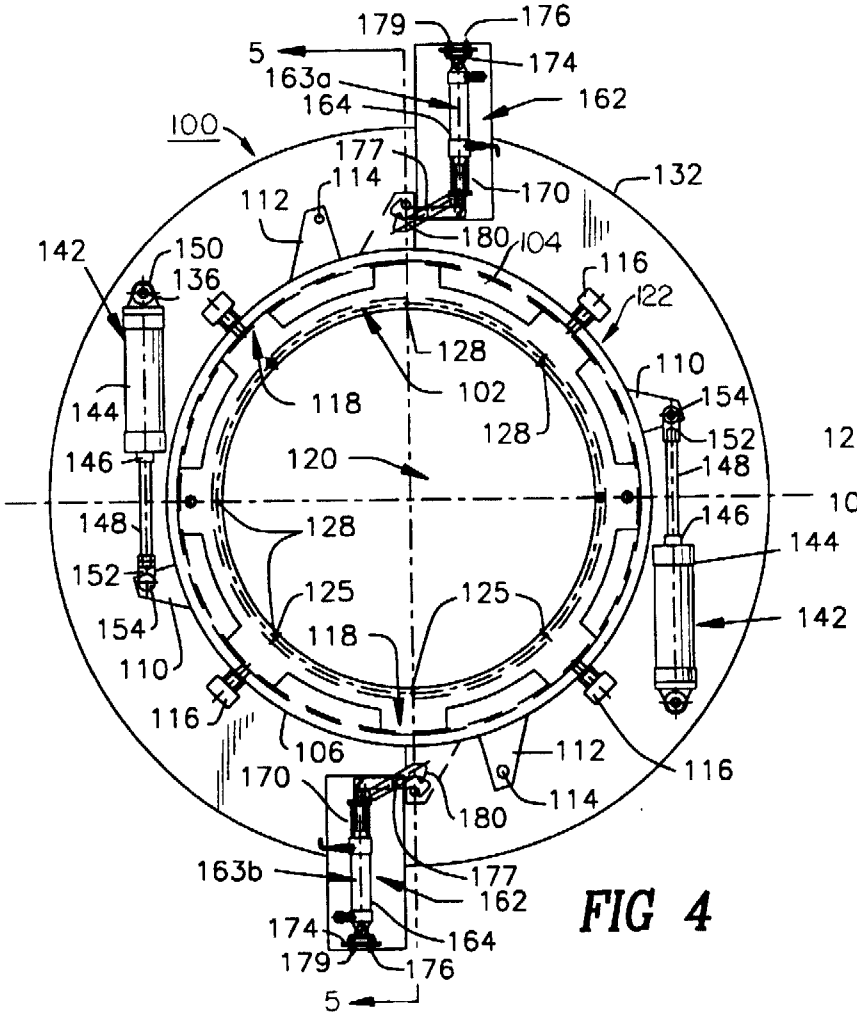
FIG. 4 is a front plan view of the locking collar assembly of the present invention showing the locking ring, retaining hub, locking ring rotation pneumatic cylinders, safety interlock pneumatic assembly and the retort support tire assembly.

The steel dog point set screws 130 allow for additional gripping between the locking collar assembly 100 and the rotary retort furnace assembly 200. These set screws 130 also relieve some of the rotational stresses put on the anchoring machine screws 128, as shown in FIGS. 4 and 5, which holds the retaining hub sub-assembly 122 to the outer circular perimeter edge 208 of rotary retort housing 202.

The locking collar assembly back plate 132 components include locking guides 134, cylinder support pivot pins 136, pivot pin spacers 138 and cylinder retaining rings 140. The locking collar assembly back plate 132 is a steel plate which is welded to the retaining hub sub-assembly 122. The lock ring sub-assembly 102 fits between this back plate 132 and the locking ring retaining flange 124. The back plate 132 supports both of the locking ring rotation pneumatic cylinder assemblies 142 and both of the safety interlock pneumatic assemblies 162. In addition, back plate 132 supports the retort driven sprocket 190 and the sprocket spacer ring 192. Further, this back plate 132 also acts as a heat shield for the locking collar assembly 100, as depicted in FIGS. 1, 2A, and 5.

Figure 3A:
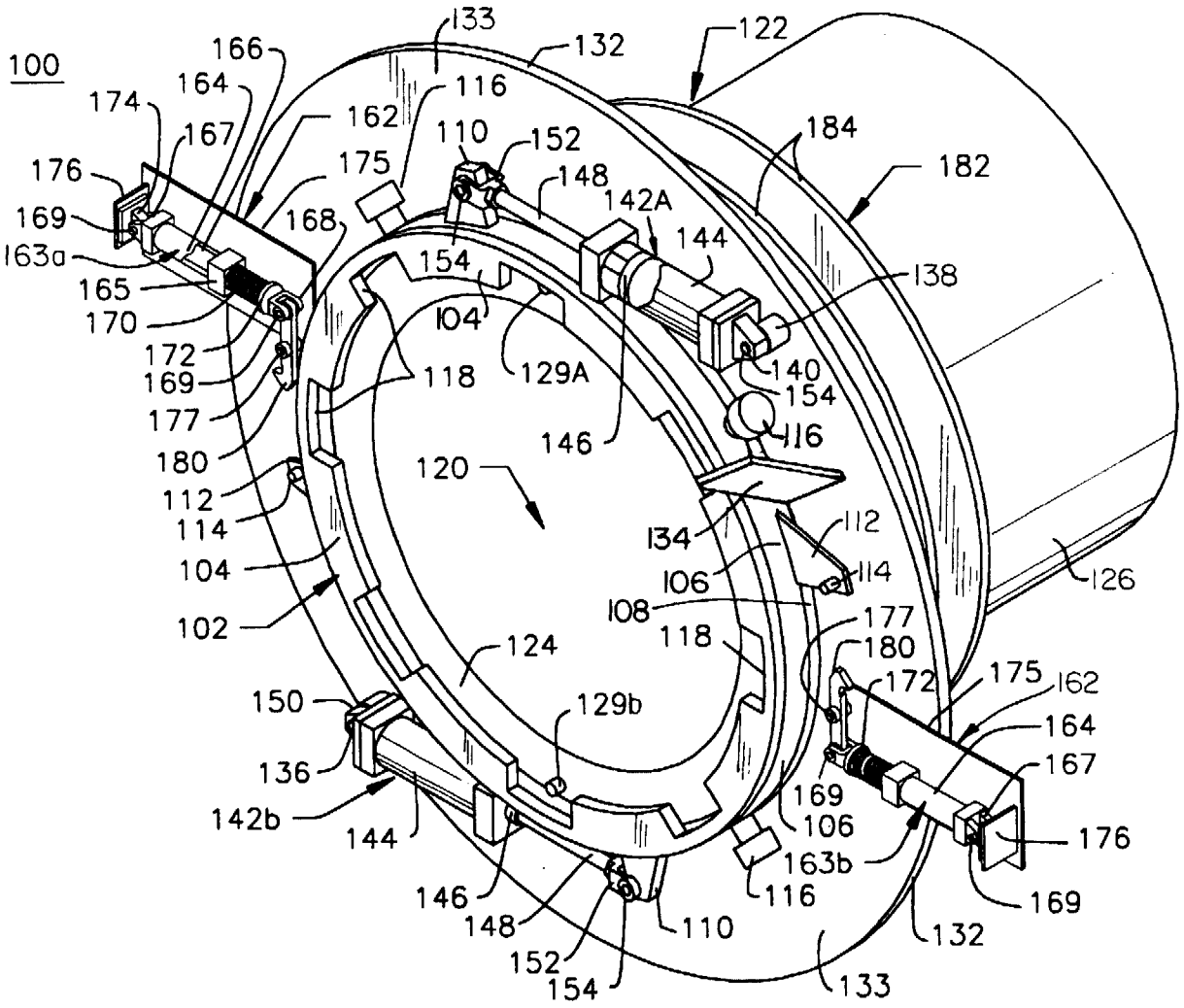
FIG. 3A is a front perspective view of the locking collar assembly of the present invention showing its major component parts contained therein.
Figure 3B:
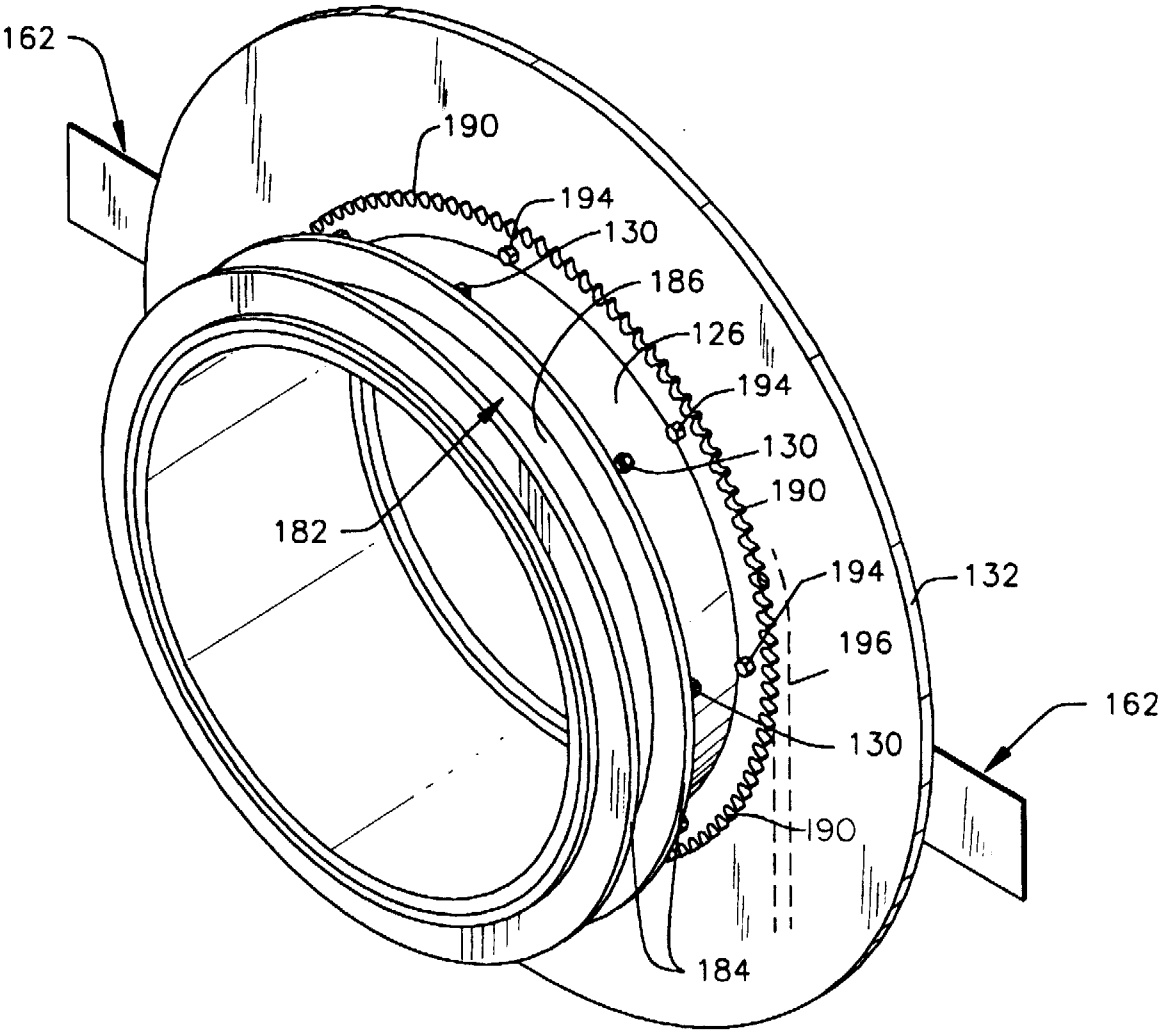
FIG. 3B is a rear perspective view of the locking collar assembly of the present invention showing its major component parts contained therein.

The locking guides 134 are steel pathways in which the locking ring cam rolls 116 follow to compress or loosen the locking ring sub-assembly 102 around the feeder mounting flange 86, as shown in FIG. 3A. The cylinder support pivot pins 136 are steel pins used to hold the locking ring rotation pneumatic cylinders 142 to the back plate 132. These pivot pins 136 also allow the rotation pneumatic cylinders 142 to pivot when these cylinders 142 are activated. The pivot pin spacer 138 is a steel spacing device which aligns the rotation pneumatic cylinders 142 and maintains the proper center line during operation of the rotation pneumatic cylinders 142. The cylinder retaining rings 140 are steel retaining rings which hold the rotation pneumatic cylinders 142 in place.

The locking ring rotation pneumatic cylinders 142*a* and 142*b* include the following component parts: a cylinder body 144, a piston ring 146, a piston shaft 148, a cylinder body clevis 150, a shaft clevis 152 and a shaft clevis retaining pin/clip 154. The rotation pneumatic cylinders 142*a* and 142*b* provide the force necessary to rotate the locking ring sub-assembly 102. When the feeder assembly 80 is to be removed, these cylinders 142*a* and 142*b* extend forward and turn the locking ring sub-assembly 102 counter clockwise, which then opens the feeder assembly 80 and provides access to the internal cavity of the retort housing 202. When the feeder assembly 80 is to be installed and/or closed, these cylinders 142*a* and 142*b* contract inwardly, forcing the locking ring sub-assembly 102 to turn clockwise to lock the feeder assembly 80 in place.

The cylinder body clevis 150 anchors the cylinder housing 144, piston ring 146 and piston shaft 148 to the back plate 132. The shaft clevis 152 anchors the cylinder housing 144, piston ring 146 and piston shaft to the locking ring sub-assembly 102. The shaft clevis retaining pin/clip 154 anchors the cylinder housing 144, piston ring 146 and piston shaft 148 to the shaft clevis 152.

The safety interlock pneumatic system assembly 162 includes a pair of interlock air cylinders 163*a* and 163*b* having a cylinder body 164, a piston ring 165, a piston shaft 166, a cylinder body clevis 167, a shaft clevis 168 and a shaft clevis retaining pin/clip 169. Pneumatic system assembly 162 further includes a pair of cylinder compression springs 170, spring retaining hubs 172, cylinder body mating devises 174, mounting plates 175 and 176, pivot pins 177, air bleeder speed control valves 178, and safety locking arms/clips 180. The safety interlock pneumatic system assembly 162 is a safety system which locks the locking ring sub-assembly 102 in place when the pneumatic system 162 is activated to the locked or closed position. This pneumatic system 162 will not allow the locking ring sub-assembly 102 to open, until it is safe to unlock and open the volumetric feeder 42. When this pneumatic system 162 is engaged, the locking ring sub-assembly 102 will not be able to rotate counter clockwise, as the safety interlock pneumatic system 162 will have to be opened first, before the locking ring sub-assembly 102 can rotate to the unlocked position.

The cylinder body clevis 167 anchors cylinder housing 164, piston ring 165, and piston shaft 166 to the mounting plate 176. The shaft clevis 168 anchors cylinder housing 164, piston ring 165, and piston shaft 166 to the rear mounting plate 175, as shown in FIG. 3A. Rear mounting plate 175 is welded to the front surface 133 of back plate 132. The shaft clevis retaining pin/clip 169 anchors cylinder housing 164, piston ring 165 and piston shaft 166 to the shaft clevis 168.

The cylinder compression spring 170 is a steel spring which provides an outward force in the interlock air cylinders 163*a* and 163*b* that keeps the safety locking arms 180 in the locked position when cylinders 163*a* and 163*b* are deactivated. The spring retaining hub 172 holds compression spring 170 in place on the interlock air cylinders 163*a* and 163*b*, as well as transferring the force (F) from the spring 170 to the cylinder shaft 166 which keeps the shaft 166 extended when the cylinders 163*a* and 163*b* are deactivated. The cylinder body mating clevis 174 anchors each of the interlock cylinders 163*a* and 163*b* to the mounting plate 176 via mounting bolts 179. The mounting plates 175 and 176, and pivot pin 177 are made of steel and provide the method by which the interlock cylinders 163*a* and 163*b* are anchored to the back plate 132 via the rear mounting plate 175. The pivot pin 177 provides the pivot point for the safety lock arm 180 to move in a clockwise direction to engage the safety lock arm pin 114 of locking arm 112.

The air bleeder speed control valves 178 provide each cylinder 163*a* and 163*b* with an activation speed of the piston shaft 166 by controlling the amount of air that is released from the cylinder body 164. Safety locking arms/clips 180 are steel hooks which pivot by means of the interlock air cylinders 163*a* and 163*b*. These arms 180 hold the locking ring sub-assembly 102 in place when it is in the locked or closed position. These locking arms 180 pivot inward to release the locking ring sub-assembly 102 when the interlock air cylinders 163*a* and 163*b* are activated, thus releasing the locking ring 102.

The retort support tire sub-assembly 182 includes a pair of guide rings 184, a machined tire 186, and a plurality of recessed cap screws 188. The retort support tire sub-assembly 182 provides the surface required for the rotary retort assembly 200 to be supported and to enable the retort housing 202 to rotate. The guide rings 184 are steel machined rings which are welded to the machined tire 186 and this provides the groove necessary for the support wheels 34 to operate correctly. The machined tire 186 is a steel ring which is made to slip over the retort adapting hub 126 of retaining hub sub-assembly 122. This tire 186 is machined to create the wear surface for the retort support wheels 34 to run on. The plurality of recessed cap screws 188 are used to anchor the retort support wheel tire sub-assembly 182 to the retort adapting hub 126, as shown in FIG. 4 of the drawings.

The retort driven sprocket 190 is a steel sprocket with an inside diameter that is large enough to fit over the retort adapting hub 126. This sprocket 190 is connected to a chain belt 196 via the drive system 32 which rotates the retort housing 202. The retort spacer ring 192 is a steel ring which causes retort driven sprocket 190 to remain on the same center line as the drive system 32 via sprocket chain 196. The sprocket machine screws 194 are used to anchor the sprocket 190 to the back plate 132.

ROTARY RETORT FURNACE ASSEMBLY 200

The rotary retort furnace assembly 200, as shown in FIGS. 1, 6, and 7, includes a main section housing 202, with an internal chamber section 203 for heat treating machine parts 12, having integrally attached component sections that include a bell end section 212, an external pathway chute 222, and a plurality of internal tumbling ribs 232 having a trapezoidal configuration 234. The main section housing 202 includes an outer surface wall 204, an inner surface wall 206, a circular perimeter wall 208, and a rectangular chute discharge opening 210 positioned adjacent to the bell end section 212.

The rotary retort furnace assembly 200 is a centrifugally cast component made up of several parts where retort assembly 200 is cast at a foundry. The retort assembly 200 is made out of a heat resisting alloy and the chamber section 203 is designed to hold 10 cubic feet of machine parts 12 to be heat treated. This rotary retort assembly 200 fits inside a furnace casing 14 and slowly rotates in a clockwise direction to feed the machine parts into the internal chamber section 203 and to process these machine parts 12 for whatever heating time period required for a proper tempering of machine parts 12. The retort assembly 200 is then reversed to a counter clockwise direction by drive system 32 which expels the machine parts 12 being heat treated under atmosphere protection to the quench tank 52.

The main housing 202 is a centrifugally cast component made up of several sections welded together to form housing 202. The length of housing 202 can vary depending upon the size of the furnace built. In the preferred embodiment, the main housing 202 has a length of nine feet, six and three-eighths inches (9'6⅜") with an outside diameter of thirty-eight and one-quarter inches (38¼"). The main housing 202 is machined for the first twenty-six inches (26") starting from the outer circular perimeter wall 208 and along the outer surface wall 204 in which to accept the locking collar assembly 100, as depicted in FIGS. 3A, 4, and 5.

The bell end section 212 is also a centrifugally cast component made-up of a few cast sections welded together to form bell end section 212. The bell end section 212 is machined to accept the bearing assembly 36 which enables the rotary retort furnace 200 to rotate while providing an atmospheric seal. Special machining provisions are employed to allow for lineal expansion when the rotary retort housing 202 is brought up to high heat-treatment temperatures. The bell end section 212 necks the retort down to a much smaller diameter to allow for more product holding capacity in the retort chamber 203 while allowing for a smaller outer-neck bearing assembly to be incorporated. The present invention utilizes a single bell end section 212 design where the standard furnace design has a double bell end structure. By using a single bell end section 212, the feeder system 80 is attached to the wide end diameter of the retort housing 202, as depicted in FIGS. 1 and 6, which allows for easy access to the inside of the retort chamber 203 for inspections, repairs, cleaning and the like, and this was not possible or extremely limited with the double bell end design of other furnaces.

The external pathway chute 222 includes the following component parts which are all made of 330 stainless steel: a front side ring wall 224, a back side ring wall 226, a pitch plate 228 and a bottom plate 230. The external pathway chute 222 is an external helix which is welded to outer wall surface 204 of retort housing 202 adjacent to the bell end section 212 and where the discharge opening 210 is located, as depicted in FIGS. 1, 5, and 6 of the drawings. The chute 222 covers approximately 270° degrees of the outside diameter of retort housing 202. This helix design makes it possible for the machine parts 12 being heat treated to remain inside the retort chamber 203, when the rotary retort furnace assembly 200 is rotating in a clockwise direction. This external pathway chute 222 also permits a carbon rich or reducing atmospheres to flow through the chute 222 and into the furnace chamber area 203 where eduction and burn-off can occur.

When the machine parts 12 being heat treated are to be discharged, the rotary retort furnace assembly 200 reverses direction to allow the machine parts 12 to dribble out and discharge with every complete rotation of retort housing 202. The external pathway chute 222 is sized to allow only a specific amount of machine parts 12 to be discharged per revolution of retort housing 202, so as to create a proper and complete quench of the machine parts 12 being heat treated. This chute 222 is what makes an internal atmospheric protected quench possible.

The front side ring wall 224 gives chute 222 its height, as it is fully welded to the retort housing 202 and allows attachment of the bottom plate 230. The back side ring wall 226 closes off the pathway after the bottom plate 230 is installed. Ring wall 226 has a longer arc length than the front side ring wall 224, and this helps to break-up and loosen the machine parts 12 during discharge which helps to make a dribble discharge possible from chute 222. The pitch plate 228 creates the steep pitch within chute 222 such that it helps the machine parts 12 to flow better (especially flat machine parts) . Pitch plate 228 also helps to prevent machine parts 12 from sticking within chute 222. Bottom plate 230 provides the surface by which the exiting machine parts 12 can ride on before discharging into the internal discharge chute assembly 300. Bottom plate 230 is also angled at the end to help provide for the dribble discharge. In addition, the bottom plate 230 also provides the surface which holds the machine parts 12 inside the retort chamber 203 when the retort housing 202 is rotating in the clockwise direction.

Tumbling ribs 232 are casted-in trapezoidal protrusions 234 which are geometrically located on the inner surface wall 206 of retort housing 202. Tumbling ribs 232 have a staggered design, as depicted in FIG. 5, such that the entire length of the machine parts 12 product load is covered and mixed on itself several times per revolution of retort housing 202. This allows for better temperature and atmosphere uniformity during the heat treatment time in the rotary retort furnace assembly 200.

INTERNAL DISCHARGE CHUTE ASSEMBLY 300

The internal discharge chute assembly 300, as shown in FIGS. 8, 9, and 13, includes a chute housing 302 having a front upper wall 304, a front lower tapered wall 306, a rear wall 308, side retaining walls 310 and 312, and tapered side walls 314 and 316; and a discharge opening 336. In addition, chute housing 302 further includes a pair of rear wall anchors 318 and 320, front and rear floor supports 322 and 324, side floor supports 326 and 328, a sighting hole opening 330, a cut-out opening 332 for retort housing 202, and a cut-out opening 334 for retort neck 214 of bell end section 212. The internal discharge chute assembly 300 is made of 330 stainless steel and is located on and adjacent to the outside wall 204 of the rotary retort furnace housing 202 which creates a pathway for the heat-treated machine parts 12 from the retort furnace chamber 203 to the outer discharge chute assembly 400. The main purpose of chute assembly 300 is to reduce or eliminate the possibility of the heat treated machine parts 12 being caught inside the furnace chamber 203 after rotary retort assembly 200 discharges the aforementioned machine parts 12 in the discharge cycle.

The front upper wall 304 closes off the open area as near as possible to the outer wall 204 of the retort housing 202. The front lower tapered wall 306 helps to guide the machine parts 12 down to the smaller discharge opening 336. The rear wall 308 provides a back to the chute housing 302 ensuring that all of the machine parts 12 enter the outer discharge chute assembly 400. The side retaining walls 310 and 312 provide a safety measure for machine parts 12 that may not discharge out of the external pathway chute 222 until the 3 o'clock position. The tapered side walls 314 and 316 also help to create the transition of machine parts 12 to the smaller discharge opening 336 of chute assembly 300. The rear wall anchors 318 and 320 allow the chute housing 302 to be held in place through the insulation on the furnace outer wall 204 adjacent to the external pathway chute 222 of housing 202, as depicted in FIG. 1. The front, rear and side floor supports 322 to 328 all together create a supporting-type flange so the internal discharge chute assembly 300 can rest on top of the brick floor lining 26 of furnace casing 14.

The sighting hole 330 located on rear wall 308 is in line with a sight glass assembly 340 on the rear wall 18 of furnace casing 14, as shown in FIG. 1. The purpose of this sighting hole 330 is to enable the operator to see the machine parts 12 that have been heat-treated in the furnace process and see the machine parts 12 being discharged from the rotary retort furnace assembly 200. The cut-out openings 332 and 334 for the retort large and small diameters allow the external pathway chute 222 to fit inside the internal discharge chute assembly 300 which will contain as much of the heat-treated machine parts 12 inside the chute housing 302 as possible.

OUTER DISCHARGE CHUTE ASSEMBLY 400

The outer discharge chute assembly 400, as depicted in FIGS. 10 to 13, includes a chute housing 402 having an upper bolting flange 402 with a plurality of mounting hole openings 405, an inner chute front wall 406, an inner chute rear wall 408, inner chute side walls 410 and 412 and an inner chute bottom flange 414. In addition, chute housing 402 further includes an outer chute front wall 416, an outer chute rear wall 418, outer chute side walls 420 and 422, an outer chute top sealing plate 424, a pair of eduction couplings 426 and 428, cooling medium jacket inlet and outlet couplings 430 and 432, chute roller extensions 434 and chute rollers 436.

The outer discharge chute assembly 400 transfers the heat-treated machine parts 12 from the internal discharge chute assembly 300 to the quench tank 52 while keeping the machine parts 12 under a sealed protective atmosphere. The outer discharge chute assembly 400 is made of steel and is bolted to the furnace floor 20 of furnace casing 14. There is a gasket 22 between the furnace flange 24 and upper bolting flange 402. The bottom section 440 of chute housing 402 falls below the quench medium 56, which creates the atmospheric seal, as shown in FIG. 13.

The upper bolting flange 402 having mounting hole opening 405 allows for the connection to the furnace mounting flange 24 via mounting bolts 407. The front, rear, and side walls 406 to 412 when welded together create the inner chute section 415 which allows the heat-treated machine products 12 to free fall into the quench medium 56. The inner chute bottom flange 414 when welded to the inner chute section 415 does not allow the machine parts 12 to enter the cooling jacket area 438. Bottom flange 414 also creates the floor of the cooling jacket area 438.

The outer chute front, rear, side walls 416 to 422, and top sealing plate 424 when welded together create the cooling jacket area 438 and fume eduction area 442. The eduction couplings 426 and 428 being angled 20° degrees upwardly are steel pipe couplings that are welded to the outer chute rear wall 418 to allow the fume eduction system (not shown) to remove quench fumes and unused furnace atmosphere from the fume system. The cooling medium jacket inlet and outlet couplings 430 and 432 are steel pipe couplings, as shown in FIGS. 10 and 11, and are welded into the inner chute walls 408 and 412. These couplings 430 and 432 supply the cooled quench medium 56 to the cooling jacket area 438 and remove heated quench medium 56 from the cooling jacket area 438. This effect cools the quench medium 56 where the machine parts 12 enter the quench medium 56 for a more uniform quench. The chute roller extensions 434 and chute rollers 436 are made of steel also and are used to support the outer discharge chute assembly 400, when the chute housing 402 in unbolted from the furnace flange 24. The chute rollers 436 make it possible to roll chute assembly 400 out from under the furnace casing 14 to a point in the quench tank 52 where the chute housing 402 can be easily removed for maintenance, repair or replacement. These chute rollers 436 also simplify the process of re-installation of the chute housing 402 under the furnace casing 14.

OPERATION OF THE PRESENT INVENTION

ATTACHMENT OF FEEDER ASSEMBLY 80 TO THE ROTARY RETORT FURNACE ASSEMBLY 200

The feeder assembly 80 has male mounting tabs 88 on feeder mounting flange 86 which are inserted into the female mounting tabs 118 of locking ring face plate 104 so that the alignment pins **129*a* and 129*b* fit through the alignment hole openings 48 of feeder mounting flange 44. When the feeder assembly 80 is in the correct position the operator depresses a "LOCK" push button 72 on the electronically controlled computerized console 70. This action by the operator causes the locking ring pneumatic cylinders 142*a* and 142*b* to become energized and contract. This causes the locking ring sub-assembly 102 to rotate in a clockwise direction an arc length of approximately 8 inches. When the locking ring sub-assembly 102 rotates in this manner, the female tabs 118 on the locking ring face plate 104 covers the male mounting tabs 46 on the feeder mounting flange 44 which holds the feeder assembly 40 firmly in place. In addition, the locking ring cam rolls 116 via locking guides 134 also cause the locking ring sub-assembly 102 to tighten inwardly which creates an increased and constant pressure between the feeder mounting flange 44 and the locking ring retaining flange 124, thus creating an atmospheric seal for the single charge continuous rotary retort furnace 10, as shown in FIG. 1**.

When the locking ring sub-assembly 102 is rotated in the full clockwise direction, the locking ring sub-assembly 102 is locked in position by safety pneumatic assemblies 162. The interlock air cylinders **163*a* and 163*b* act as safety components for the locking collar assembly 100 as these interlock air cylinders 163*a* and 163*b* prevent accidental activation of the locking rotation pneumatic cylinders 142*a* and 142*b*. When the interlock air cylinders 163*a* and 163*b* are activated the pneumatic cylinders 142*a* and 142*b* are then interlocked so the locking ring sub-assembly 102 cannot be opened, without it being safe to do so. When the feeder assembly 80 and the locking collar assembly 100 are correctly in place, the electronic console senses this condition, and the rotary retort furnace 10** can be safely operated.

OPERATIONAL MODE FOR THE ROTARY RETORT FURNACE 10

The operator now establishes the proper operating temperature and the proper atmospheric environment for the machine parts 12 to be heat treated, and then a single charge of machine parts 12 is loaded into the volumetric spiral feeder assembly 80. The rotary retort assembly 200 is then started-up by motor drive system 32 and its rpm is increased to approximately 5 rpm to load the machine parts 12 to be heat treated, as fast as possible, into the retort furnace chamber 203 of retort housing 202. The machine parts 12 then pass through two consecutive atmospheric sealing doors (not shown) within feeder assembly 80 and into the retort furnace chamber 203 of retort housing 202 in which to start the heat treating process. The rotary retort furnace assembly 200 is rotated in a clockwise direction (process direction) at a reduced rpm of approximately 1 to 2 rpm, so that the machine parts 12 tumbling inside the retort furnace chamber 203 will not nick, dent or damage themselves while being tumbled slowly. When the heat-treating process of machine parts 12 has been completed, the rotary retort furnace assembly 200 stops, then reverses its direction and increases rotational speed to approximately 5 rpm and discharges the machine parts 12 into the internal discharge chute assembly 300. The machine parts 12 then enter the outer discharge chute assembly 400 and free fall into the quench medium 56 of quench tank 52. This aforementioned heat treating process is continued for each lot of machine parts 12 that is supplied to the furnace 10.

REMOVING THE FEEDER ASSEMBLY 80 FOR MAINTENANCE INSPECTION

When the operator is satisfied that safety sensors on the electronically controlled computerized console 70 of furnace 10 show that the rotary retort furnace assembly 200 has had a nitrogen purge, has been degassed, that the temperature of retort furnace chamber 203 has fallen to room temperature, and that the retort housing 202 has stopped rotating, then the locking collar assembly 100 "UNLOCK" push button 74 is activated, as shown in FIG. 14, and can be depressed by the operator. When this "UNLOCK" push button 74 is depressed by the operator, the safety interlock pneumatic cylinders **163*a* and 163*b* activate to open the safety locking arms 180. Once these locking arms 180 are in the opened position, the locking ring rotation pneumatic cylinders 142*a* and 142*b* energize to extend the piston ring 146 and the piston shaft 148 of each cylinder 142*a* and 142*b*. This in-turn causes the locking ring sub-assembly 102 to rotate in a counter clockwise direction which relieves the constant pressure that was between the feeder mounting flange 44 and the locking ring retaining flange 124. The male tabs 46 of feeder mounting flange 44 are then released such that the feeder assembly 80 can be removed by a crane. With the feeder assembly 80 removed and the locking collar assembly 100 in an open position, the operator now can provide maintenance, repair or replacement to the various assemblies 100, 200, 300, and 400**.

ADVANTAGES OF THE PRESENT INVENTION

Accordingly, an advantage of the present invention is that it provides for a single charge continuous rotary furnace having a micro feeder system which automatically fills the hopper feeder with metal parts to be treated; and feeds those metal parts into the retort furnace. This volumetric or spiral feeder system reduces manual labor and time, increases safety of the operator and increases productivity of the operation. This furnace design also reduces downtime by allowing faster removal of the feeder assembly.

Another advantage of the present invention is that it provides for a single charge continuous rotary furnace having a micro feeder system with an automatic feeder locking collar which provides for immediate access to the inside of the retort assembly. This reduces downtime and costly repairs; and increases productivity as this feeder design allows for faster charging of machine parts into the retort chamber.

Another advantage of the present invention is that it provides for a single charge continuous rotary furnace having a new and improved retort design with a larger diameter opening at the feeder end for ease of access to the retort. This ease of access makes it possible for operator personnel to actually fit inside the retort chamber in which to make repairs; remove fused or stuck machine parts product that were heat-treated; and inspect the alloy or modify the tumbling ribs that are attached to the inside surface wall of the retort chamber. The current design of rotary retort of the present invention makes these features available which were not possible in existing furnace designs.

Another advantage of the present invention is that it provides for a single charge continuous rotary furnace having a retort assembly with an improved pattern design with rows of tumbling ribs made of high tensile strength metal which allows for the proper tempering of the heat treated metal parts within the rotary retort. This eliminates the use of spacing discs, reduces the replacement of internal part replacements, reduces downtime maintenance and labor costs, and increases productivity.

Another advantage of the present invention is that it provides for a single charge continuous rotary furnace having a new and improved external discharge chute with an internal protective atmospheric seal which improves the quality of the quench and the quality of the metal products produced.

Another advantage of the present invention is that it provides for a single charge continuous rotary furnace having a controlled gaseous atmosphere for the proper heat treating of metal parts before quenching, thereby eliminating the need for many other downstream procedures which reduces the cost of producing a heat treated metal product and provides a substantial cost savings.

Another advantage of the present invention is that it provides for a single charge continuous rotary furnace which can be automatically operated by the use of an electronically controlled computerized console such that the machine parts being heat treated can be loaded to a given number automatically and discharged automatically without manual intervention.

Another advantage of the present invention is that it provides for a single charge continuous rotary furnace having sight-glass viewing parts 40 view the machine parts being heat treated in the retort chamber.

A further advantage of the present invention is that it provides for a single charge continuous rotary furnace which can be produced in an economical manner and is readily affordable by a manufacturer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A single charge continuous rotary retort furnace for heat treating machine parts in a sealed atmosphere, comprising:

a) a rotary retort furnace housing having an inlet and outlet end;

b) a feeder assembly at said inlet end having at least one chamber for supplying the machine parts to said rotary retort furnace housing to be heat treated;

c) a locking collar assembly for connecting said feeder assembly to the inlet end of said rotary retort furnace housing;

d) locking means for locking said feeder assembly to said locking collar assembly;

e) means for rotating said locking collar assembly relative to said feeder assembly;

f) means for sealing said feeder assembly relative to said locking collar assembly to create an atmospheric seal in said retort furnace housing for enabling the machine parts to be heat treated;

g) drive means for rotating as a unit said retort furnace housing, said feeder assembly and said locking collar assembly for heat treating the machine parts;

h) an internal discharge chute assembly cooperating with the outlet end of said rotary retort furnace housing for removing therefrom the heat-treated machine parts; and i) an outer discharge chute assembly cooperating with said internal discharge chute assembly for receiving the heat-treated machine parts from said internal discharge chute assembly and for transferring the machine parts to a quench medium in a quench tank.

2. A single charge continuous rotary retort furnace in accordance with claim 1, wherein said feeder assembly is a volumetric feeder having a series of interior chambers with pressurized entrance and exit means for providing a controlled rate of feed of the machine parts to said rotary retort furnace housing.

3. A single charge continuous rotary retort furnace in accordance with claim 1, wherein said feeder assembly is a spiral feeder having a series of interior spiral chambers with pressurized entrance and exit means for providing a controlled rate of feed of the machine parts to said rotary retort furnace housing.

4. A single charge continuous rotary retort furnace in accordance with claim 1, further including an electronically controlled computerized console for controlling the operations of said retort furnace.

5. A single charge continuous rotary retort furnace in accordance with claim 1, wherein said locking means includes a plurality of interlocking male mounting tabs and female mounting tabs.

6. A single charge continuous rotary retort furnace in accordance with claim 1, wherein said means for rotating said locking collar assembly includes pneumatic piston and cylinder means.

7. A single charge continuous rotary retort furnace in accordance with claim 1, wherein said means for sealing includes pneumatic piston and cylinder means and bleeder valves for controlling the rate of sealing.

8. A single charge continuous rotary retort furnace in accordance with claim 1, wherein said drive means includes a retort tire sub-assembly having a guide surface for rotating said rotary retort furnace housing.

9. A single charge continuous rotary retort furnace in accordance with claim 8, wherein said drive means further includes a sprocket and chain belt connected to a motor for rotating said rotary retort furnace housing.

10. A single charge continuous rotary retort furnace in accordance with claim 1, wherein said rotary retort furnace housing includes a main section having an interior chamber section for heat treating the machine parts.

11. A single charge continuous rotary retort furnace in accordance with claim 10, wherein said rotary retort furnace housing includes a bell end section integrally attached to one end of said main section for funneling of the heat treated machine parts to an exit port.

12. A single charge continuous rotary retort furnace in accordance with claim 11, wherein said bell end section includes an integrally attached external pathway chute connected at said exit port for discharging of the heat-treated machine parts; and for allowing carbon rich or reducing atmospheres to flow through said external pathway chute and into said interior chamber section of said main section of said rotary retort furnace housing where eduction and burn-off can occur.

13. A single charge continuous rotary retort furnace in accordance with claim 12, wherein said external pathway chute has an external helix configuration which covers at least 270° degrees of the outside diameter of said rotary retort furnace housing which is sized to allow only a specific amount of the heat treated machine parts to be discharged per revolution of said rotary retort furnace housing.

14. A single charge continuous rotary retort furnace in accordance with claim 10, wherein said interior chamber section of said main section of said rotary retort furnace housing includes a plurality of internal tumbling ribs having a trapezoidal configuration located on the inner surface wall.

15. A single charge continuous rotary retort furnace in accordance with claim 14, wherein said internal tumbling ribs are arranged in a staggered geometric pattern on said inner surface wall of said interior chamber section; and said internal tumbling ribs are used to mix and tumble the heat-treated machine parts.

16. A single charge continuous rotary retort furnace in accordance with claim 12, wherein said internal discharge chute assembly includes a tapered housing having a first cut-out opening for receiving the main section of said rotary retort furnace housing and a second cut-out opening for receiving the retort neck of said bell end section of said rotary retort furnace housing which creates a pathway for receiving the heat-treated machine parts from said interior chamber section and for transferring them to said outer discharge chute assembly.

17. A single charge continuous rotary retort furnace in accordance with claim 1, wherein said outer discharge chute assembly includes an outer chute housing having a top sealing plate, a pair of eduction couplings, cooling medium couplings which transfer the heat-treated machine parts from said internal discharge chute assembly to said quench tank.

* * * * *